US009341402B1

(12) United States Patent
Loudermilk et al.

(10) Patent No.: US 9,341,402 B1
(45) Date of Patent: May 17, 2016

(54) REFRIGERATOR WITH VENTED AIR FLAP BETWEEN ICEMAKING COMPARTMENT AND ICE STORAGE AREA

(71) Applicant: Whirlpool Corporation, Benton Harbor, MI (US)

(72) Inventors: Aaron Lee Loudermilk, Mt. Carmel, IL (US); Garett L. Strandemo, Evansville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 353 days.

(21) Appl. No.: 13/672,967

(22) Filed: Nov. 9, 2012

(51) Int. Cl.
*F25C 5/00* (2006.01)
*F25C 5/18* (2006.01)

(52) U.S. Cl.
CPC ..... *F25C 5/005* (2013.01); *F25C 5/182* (2013.01)

(58) Field of Classification Search
CPC .... F25C 2400/04; F25C 5/005; F24F 13/082; F24F 13/105; F24F 13/1413; F25D 17/065; F25D 17/045; F25D 23/04; F25D 23/025; F25D 2317/061; F25D 2317/062; F25D 2317/065; F25D 2317/0667
USPC ..... 62/250, 340, 344, 420–425, 459, 62/186–187, 377
See application file for complete search history.

(56) References Cited

U.S. PATENT DOCUMENTS

| | | | | |
|---|---|---|---|---|
| 5,029,737 | A * | 7/1991 | Yamamoto | 222/526 |
| 8,234,880 | B2 | 8/2012 | Kim et al. | |
| 8,302,423 | B2 | 11/2012 | Lee et al. | |
| 2006/0260345 | A1* | 11/2006 | Coulter et al. | 62/340 |
| 2007/0119202 | A1* | 5/2007 | Kadowaki et al. | 62/340 |
| 2008/0156017 | A1* | 7/2008 | Johnson et al. | 62/320 |
| 2008/0236187 | A1 | 10/2008 | Kim | |
| 2008/0248738 | A1* | 10/2008 | Newton et al. | 454/322 |
| 2010/0257889 | A1* | 10/2010 | Lee | 62/344 |
| 2011/0146326 | A1* | 6/2011 | Choi | 62/344 |

FOREIGN PATENT DOCUMENTS

WO 2010145227 A1 12/2010

* cited by examiner

*Primary Examiner* — Jose O Class-Quinones

(57) ABSTRACT

A household refrigerator includes an icemaker in the cabinet and an ice storage area on a door. An ice flow passage extends between the icemaker and the ice storage area. A moveable flap is associated with the ice flow passage to cover an opening in the ice flow passage on the cabinet when the door is open. The moveable flap has an equilibrium position wherein the movable flap substantially covers the ice flow passage. A vent in the flap permits air to flow through the ice flow passage to the ice storage area with the movable flap in the equilibrium position. As ice moves through the ice passage from the icemaker towards the ice storage area, the momentum of the moving ice moves the movable flap from the equilibrium position to the dispensing position to permit the ice to flow to the ice storage area.

18 Claims, 8 Drawing Sheets

REFRIGERATOR WITH VENTED AIR FLAP BETWEEN ICEMAKING COMPARTMENT AND ICE STORAGE AREA

FIELD OF THE INVENTION

This invention relates generally to household refrigerators and more particularly to household refrigerators with automatic icemakers.

BACKGROUND OF THE INVENTION

Household refrigerators commonly include an icemaker to automatically make ice. The icemaker includes essentially an ice mold for forming ice cubes and a supply of water. Heat is removed from the liquid water within the mold to form ice cubes. After the cubes are formed they are harvested from the mold. The harvested cubes are typically retained within a bin or other storage container. The storage bin may be operatively associated with an ice dispenser that allows a user to dispense ice from the refrigerator without opening the refrigerator door.

It can be advantageous to have the ice bin located remotely from the icemaker, especially in refrigerators that have the freezer compartment mounted below the fresh food compartment. According to one known design, the icemaker is located within an insulated icemaking compartment contained within or adjacent to the fresh food compartment, and the ice storage bin is located on the fresh food door.

An ice flow passageway must be provided to permit the ice cubes to move from the icemaker to the ice storage bin. When the icemaking compartment is located in the cabinet and the ice storage area is located on the door, there is a breakable joint along the ice flow passageway. It is preferred that this joint be insulated and sealed to prevent the cold air from the ice making compartment and ice storage area from bleeding into the fresh food compartment. When the fresh food compartment door is opened, the cross-section of the passageway on the cabinet side is left open to ambient air. Furthermore, it can be visually unattractive to leave the cabinet-side of the passageway open when the fresh food door is opened.

Therefore, it has been known to include a flap or door that closes the ice flow passageway when the fresh food door is opened. This flap can impede the flow of ice from the icemaker to the ice bin and can impede the flow of air from the icemaking compartment to the ice storage area. One solution that permits flow of ice and air when the fresh food door is closed is a push button or lever that is activated by the door being brought into close proximity to the cabinet that causes the flap to rotate to an open configuration. However, this activation mechanism increases the complexity and cost of the refrigerator, as well as detracting from the clean appearance of the cabinet.

The present invention is an improvement over existing designs.

BRIEF SUMMARY OF THE INVENTION

According to one embodiment the present invention is a refrigerator that includes a cabinet and a door on the cabinet. An icemaker is mounted within the cabinet. An ice storage area is provided on the door. An ice flow passage extends from the ice maker and the ice storage area. A moveable flap is associated with the air flow passage. The moveable flap has an equilibrium position wherein the moveable flap substantially covers the ice flow passage. A vent is provided in the flap to permit air flow through the ice flow passage to the ice storage area with the moveable flap in the equilibrium position. The moveable flap may be movable to a dispensing position that permits ice to flow from the icemaker to the ice storage area. Movement of the moveable flap from the equilibrium position to the dispensing position may be caused by momentum of moving ice passing through the ice flow passage from the ice maker towards the ice storage area. The flap may be biased to automatically move from the dispensing position to the equilibrium position. The movable flap may be biased towards the equilibrium by gravity. The movable flap may be mounted to rotate about a rotation member, wherein when the movable flap its center of gravity is offset from the rotation member to create a moment force about the rotation member that urges the movable flap towards the equilibrium position. The ice storage area may include an opening for exhausting air from the ice storage area to the fresh food compartment. The vent may be an elongated slot. The vent may include a plurality of horizontal slots. The refrigerator may include a return vent in the cabinet for exhausting air from the ice storage area back to the cabinet. A gasket may be provided between the door and the cabinet that surrounds the ice flow passage when the door is in a closed position to prevent air from leaking from the ice storage area to the fresh food compartment.

According to another embodiment, the present invention is a refrigerator that includes an icemaker in a refrigerator cabinet and an ice container on a door that is mounted to the refrigerator cabinet. A passageway is provided in the refrigerator cabinet positioned to receive ice from the icemaker. A moveable flap is rotatably mounted to the passageway. The moveable flap has an equilibrium position wherein the moveable flap substantially covers the passageway. The moveable flap has an opening through it. The passageway may have a bottom surface that slopes downwardly towards the moveable flap. The downward slope of the bottom surface may be sufficiently steep such that ice on the bottom surface will slide down the passageway under the force of gravity. The ice sliding on the bottom surface under the force of gravity has sufficient momentum to move the movable flap from the equilibrium position to a dispensing position that permits the ice to move to the ice container. The movable flap may be mounted to rotate about a rotation member such that when the movable flap is in a dispensing position a center of gravity of the moveable flap is offset from the rotation member to create a moment force about the rotation member that urges the movable flap towards the equilibrium position. The opening in the moveable flap may be an elongated horizontal slot or a plurality of elongated horizontal slots. A return vent may be provided in the cabinet for exhausting air from the ice container back to the refrigerator cabinet. A gasket may engage the cabinet and the door and surround the passageway and the return vent when the door is in a closed position to prevent cold air from leaking from the passageway and the return vent to a fresh food compartment.

DETAILED DESCRIPTION OF PREFERRED EMBODIMENTS

Figure 1:
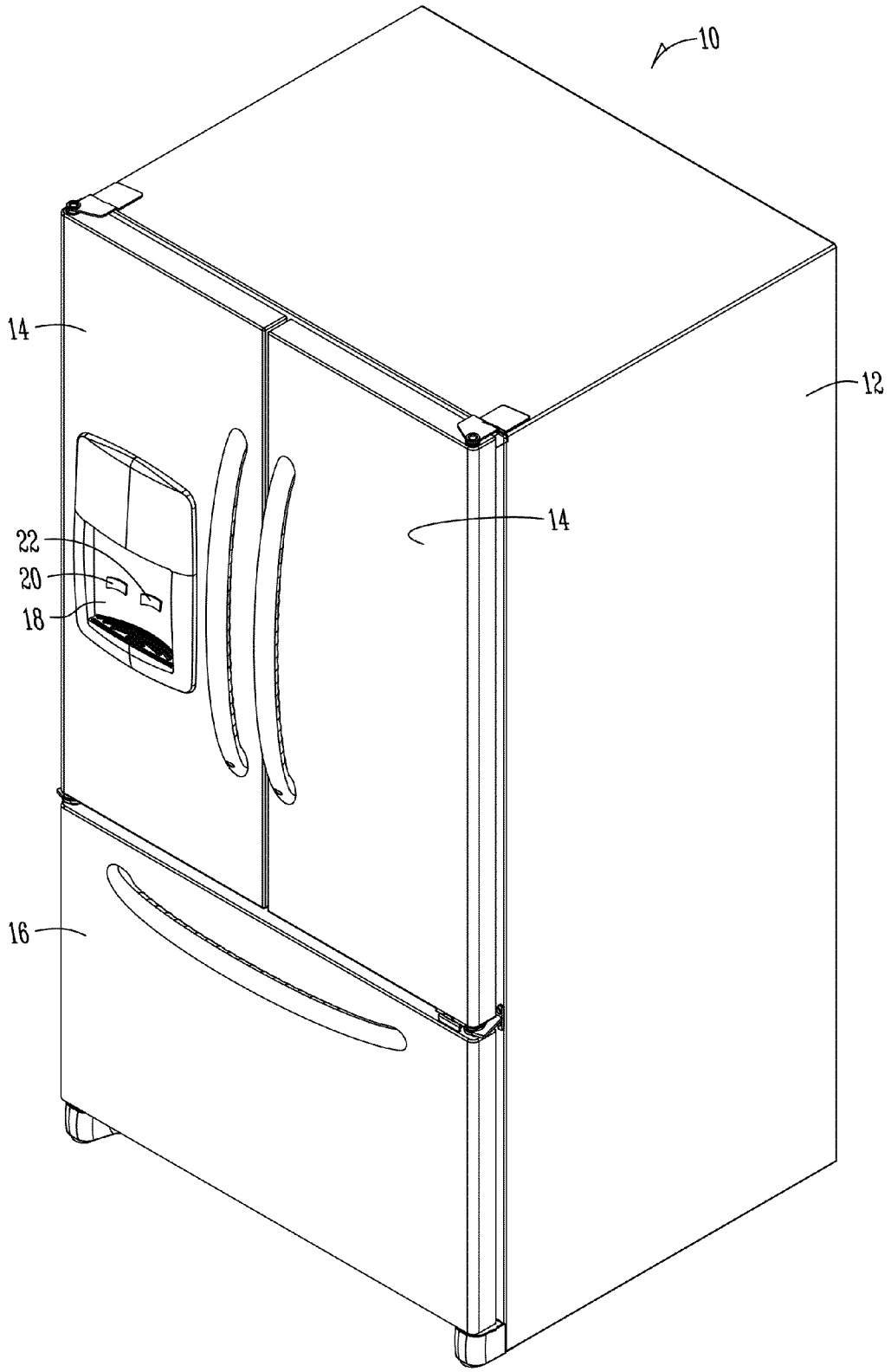
FIG. 1 is an isometric view of a refrigerator according to one embodiment of the present invention.

FIG. 1 shows a refrigerator 10 according to one embodiment of the present invention. The refrigerator 10 includes a cabinet 12 with attached fresh food doors 14 and freezer compartment door 16. It should be appreciated that while the fresh food doors 14 are shown as French doors, a single door could be used. Similarly, while the freezer door 16 is shown as a drawer type, it could be hingedly attached to the cabinet. The cabinet 12 and doors 14, 16 should be insulated. The refrigerator 10 includes chilling equipment (not shown) and an attachment (not shown) for connection to a power source. The refrigerator 10 also includes an inlet (not shown) for connection to a supply of water for use in making ice and dispensing fresh water.

One of the fresh food doors 14 is provided with a dispensing area 18 with an ice dispenser 20 for dispensing ice through the fresh food door 14, even when the fresh food door 14 is closed. The dispensing area 18 also preferably includes a water dispenser 22 for dispensing chilled drinking water through the fresh food door 14.

Figure 2:
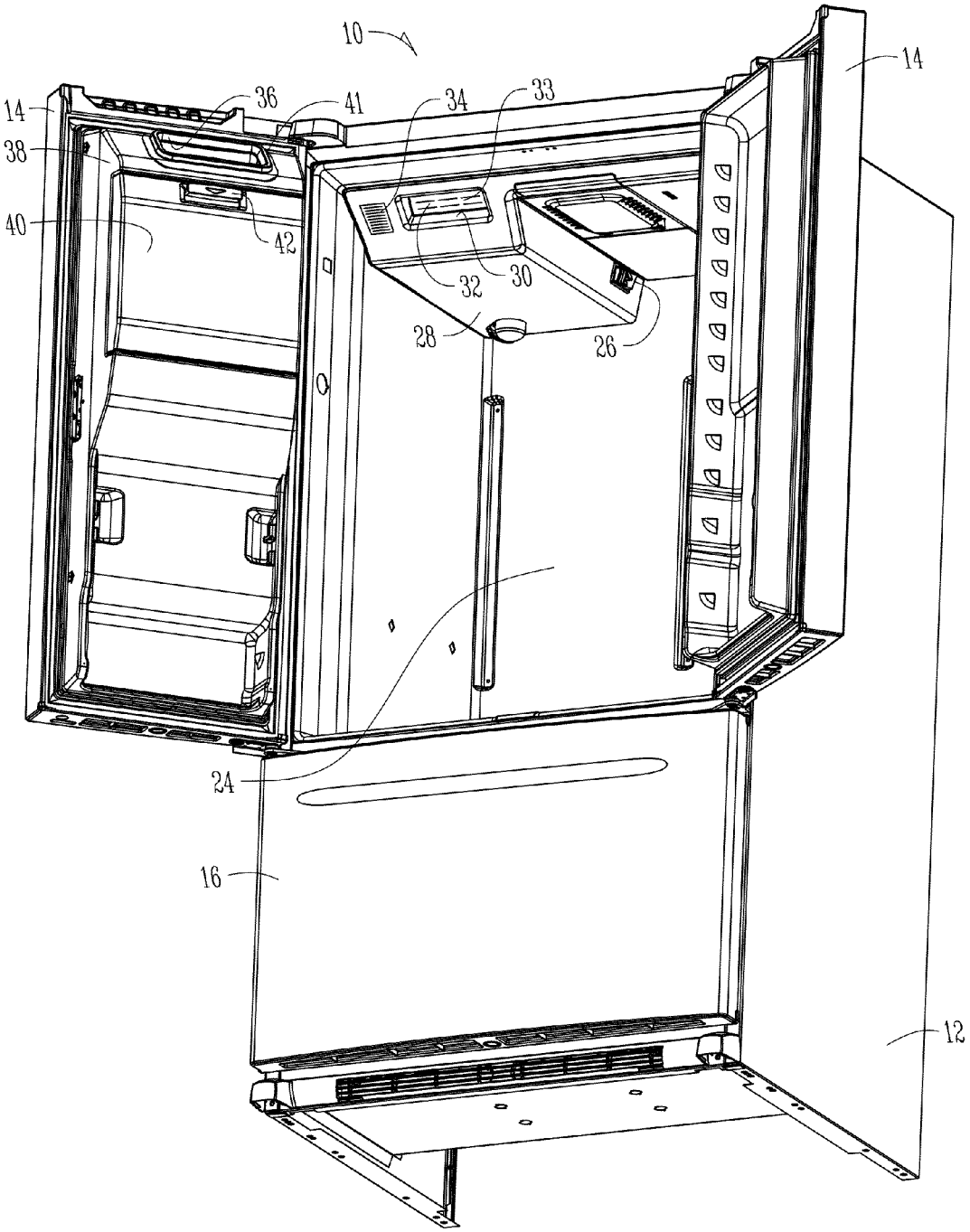
FIG. 2 is an isometric view of the refrigerator of FIG. 1, with the doors of the fresh food compartment in an open configuration.

FIG. 2 shows the refrigerator 10 of FIG. 1 with the fresh food doors 14 opened. With the doors 14 opened, the fresh food compartment 24 can be seen. The fresh food compartment 24 may be provided with shelving and drawers (not shown) to support and display food and other items stored in the fresh food compartment 24. Air within the fresh food compartment is typically maintained below 40 degrees Fahrenheit, but above the freezing temperature of water (32 degrees Fahrenheit). Cold air can be provided to the fresh food compartment 24 through fresh food vent 26. Additional vents (not shown) connected to air ducts (not shown) that are in communication with the chilling equipment may also be provided. Return ducts (not shown) may also be provided to permit air flow through the fresh food compartment. Alternatively, the airflow system for the fresh food compartment may be separate from the air flow to the ice compartment.

Ice compartment housing 28 is provided in the cabinet 12 at an upper portion of the fresh food compartment 24. The ice compartment housing 28 is insulated and forms a portion of the top wall or roof of the fresh food compartment 24. The vent 26 is formed at the rear of the ice compartment housing 28. The ice compartment housing 28 may be made of molded plastic or similar refrigerator appropriate material. The ice compartment housing 28 encloses an ice compartment that includes the ice maker and an air flow system for chilling the ice maker (see FIG. 4) and the stored ice. The same or a separate air flow system may be used to provide cold air to the fresh food compartment 24. It may be desirable to include heaters within the housing 28 to prevent frost build up. While the icemaking compartment is shown to be in one of the upper corners of the fresh food, compartment 24, other locations are also within the scope of this invention.

The front face of the ice compartment housing 28 includes an ice flow passage opening 30 that leads from the exterior of the ice compartment housing 28 to the internal ice compartment. A moveable flap 32 is provided to cover the ice flow passage opening 30 when the fresh food door 14 is opened. The ice compartment moveable flap 32 is normally in the equilibrium closed position shown in FIG. 2. A return air vent 34 is also provided through the front of the ice compartment housing 28. As will be described in more detail with respect to FIGS. 5 and 6*a*, a vent 33 is provided in the flap 32 to allow for air flow from the icemaking compartment to the ice storage compartment.

The ice flow passage opening 30 in the ice compartment housing 28 aligns with an ice flow passage opening 36 formed in the ice storage compartment housing 38 on the inner surface of one of the fresh food doors 14. A gasket 41, or similar seal, is provided to provide an air tight connection between the ice compartment housing 28 and the ice storage compartment housing 38 surrounding the openings 30 and 36 when the fresh food door 14 is closed. It should be noted that the ice flow passage opening 36 on the ice storage compartment housing 38 is larger than the ice flow passageway opening 30 in the ice compartment housing 28. This is so that the opening 36 on the ice storage compartment 38 side will align with both the ice flow passage opening 30 and the return air vent 34 on the ice compartment housing 28. Furthermore, it should be appreciated that the gasket 41 should be large enough to surround both air flow passageway openings 36 and 38, and the return vent 34. Therefore, when the fresh food door 14 is closed, an airtight ice flow passage is provided from the ice compartment to the ice storage compartment. While the seal 41 is shown located on the ice storage compartment housing 38, it could be located on the ice compartment housing 28.

With continued reference to FIG. 2, the ice storage compartment housing 38 is provided on an inner portion of the fresh food door 14. An openable ice storage compartment cover 40 is provided on the ice storage compartment housing 38 to provide access to an ice storage compartment formed within the housing 38. The housing 38 and cover 40 should be insulated. It may be desirable to include heaters within the housing 38 and cover 40 to prevent frost build up. The cover 40 is shown as a hinged cover, but may be removable, and may be attached to an ice bin that is generally stored within the ice storage compartment to hold and store ice. A finger operated latch 42 provides a mechanism for selectively opening the cover 40.

Figure 3:
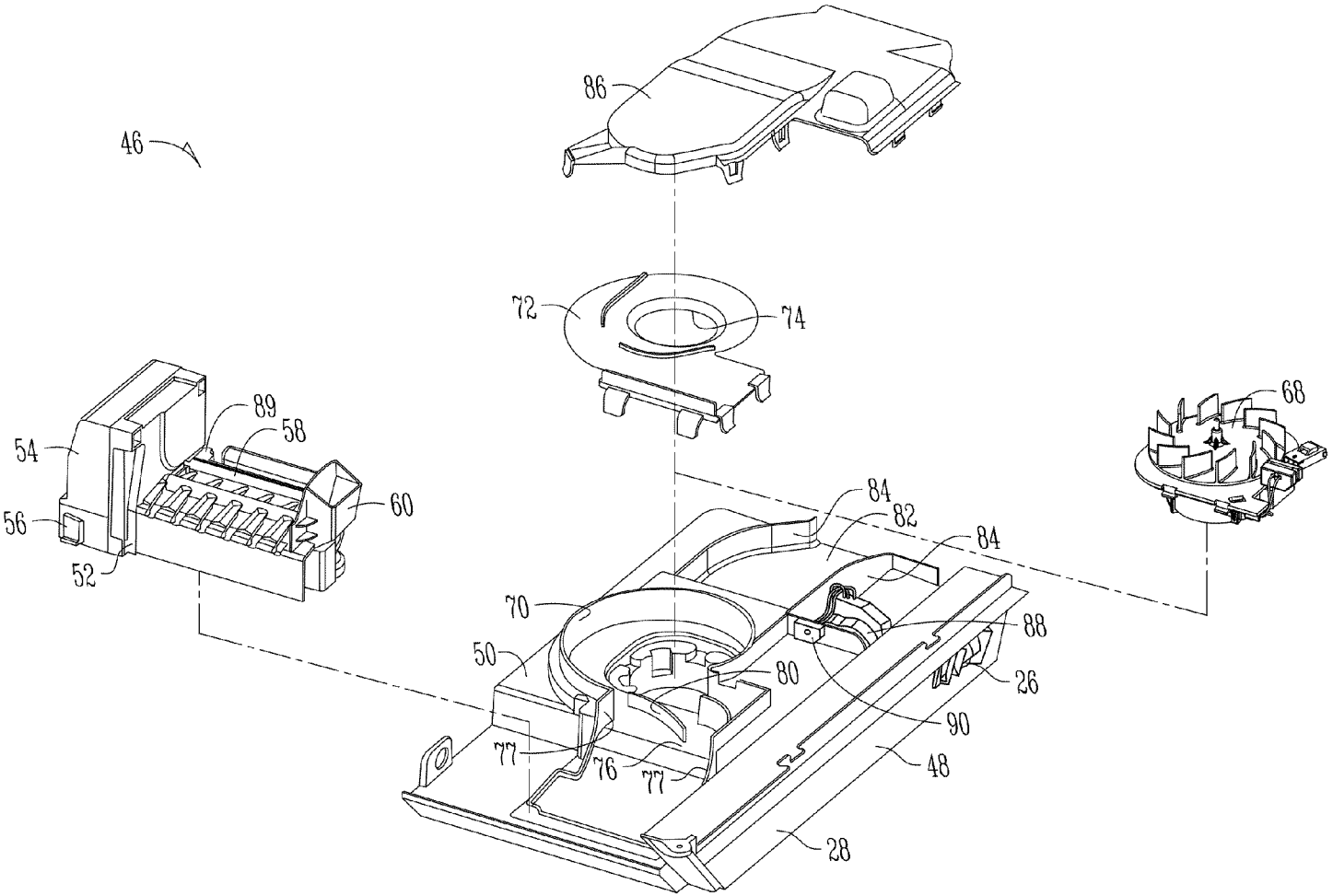
FIG. 3 is an exploded detail view of the components of an icemaking compartment according to one embodiment of the present invention.

FIG. 3 shows an exploded view of assembly 46 used to form an ice compartment and air flow system according to one embodiment of the present invention. The lower portion of the assembly 46 is formed by the ice compartment housing 28. The housing 28 may include an outer shell 48 and an upper layer 50. There may also be an additional layer or layers with various contours between the upper layer and the outer shell 48. Insulation may be provided between the outer shell 48 and the other layers.

An icemaker 52 is mounted to and supported by the housing 28. The ice maker 52 includes a control unit 54 with and internal motor and a test switch 56 for testing the ice maker 52. The ice maker 52 also includes an ice mold 58 in which ice is formed. Water is added to the ice mold 58 through fill cup 60. Different designs for the icemaker 52 will be suitable for use with the present invention.

The assembly 46 includes a low-profile radial-flow impeller 68. A scroll chamber 70 is formed around the impeller within the housing 28. A top plate 72 covers the impeller 68 within the scroll chamber 70 and provides an inlet opening 74 for air flow into the impeller 68. The impeller 68 rotates about a generally vertical axis. The scroll chamber 70 limits the flow of air out of the impeller 68 to either flow towards the ice maker via the ice maker air flow pathway 76 defined by guides 77 or through a fresh food compartment air flow pathway 78 (not visible in FIG. 3, see FIG. 5). A curved vane 80 is provided within the ice maker air flow pathway 76 between the impeller 68 and the ice maker 52. The rear of the housing 28 includes an air flow inlet pathway 82 defined by guide walls 84. A top cover 86 snaps on to the housing 28 to fully cover the air flow inlet pathway 82 and the impeller 68 and impeller scroll chamber 70.

A damper 88 is provided within the fresh food compartment pathway 78 (see FIG. 5) to permit and prevent air flow from the impeller 68 through the vent 26 via the fresh food compartment pathway 78. An electrical connection 90 is provided to attach the damper 88 to a power source.

A temperature sensor 89 is provided on the ice mold 58. In the embodiment shown the sensor 89 is located near the control unit 54 of the ice maker 52. The sensor 89 may be a thermistor. The sensor 89 is used to determine when the ice is ready for harvest. When the ice mold reaches a predetermined temperature, the control unit 54 harvests the ice from the mold 58. Typically harvest is accomplished by warming the mold 58, and rotating fingers (not shown) that extract the ice out of the mold 58. Other known mechanisms may be used for harvesting the ice.

Furthermore, it should be appreciated that rather than using the impeller design of FIG. 3, a conventional fan, including a fan located remotely from the ice compartment may be used. For example, a fan at or near the evaporator may be used to provide air to the ice maker.

Figure 4:
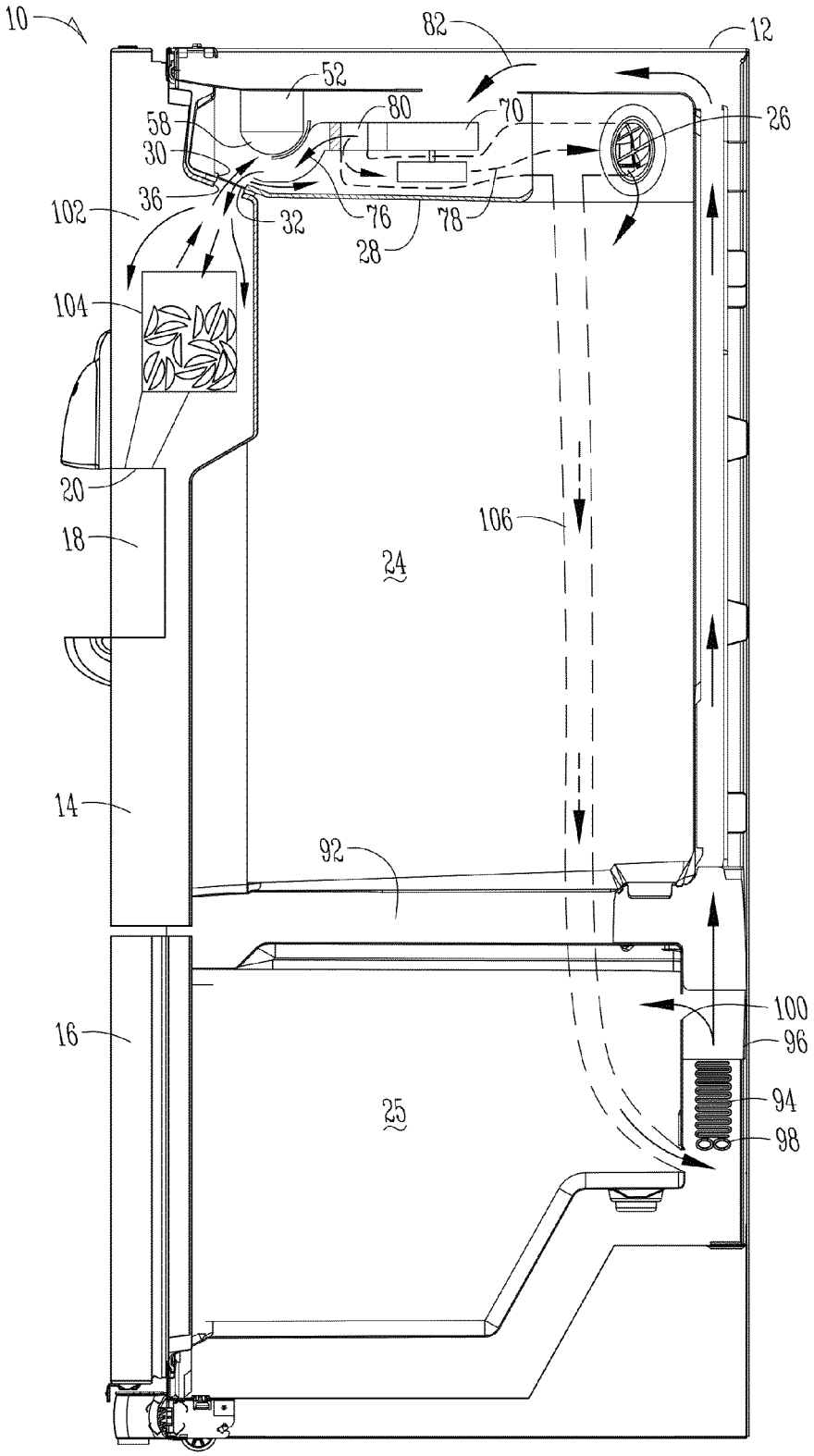
FIG. 4 is a side elevation air-flow diagram according to the embodiment of FIG. 3.

FIG. 4 is a cross-sectional air-flow diagram of a refrigerator 10 that has the assembly 46 mounted at the top portion of the refrigerator cabinet 12, generally adjacent to or within the fresh food compartment 24. The fresh food compartment 24 is located above the freezer compartment 25. An insulated mullion 92 separates the fresh food compartment 24 from the freezer compartment 25. Cooling for the refrigerator 10 is provided by an evaporator 94 provided within or at least in thermal communication with a riser duct 96. A fan 98 moves air across the evaporator 94 and through the riser duct 96.

Air from the riser duct is supplied to the freezer compartment 25 through vent 100. Optionally the vent 100 may be provided with a damper to selectively open and close the vent 100.

The riser duct also supplies cold air to the inlet air flow pathway 82 at the rear of the housing 28. The cold air supplied to the inlet air flow pathway 82 flows through radial impeller scroll chamber 70. If the impeller is running, the cold air is impelled rapidly towards the ice maker 52.

When the ice is harvested from the ice mold 58, it drops through ice pathway openings 30 and 36 into an ice storage compartment 102 within the door 14. The weight and momentum of the ice causes the moveable flap 32 to rotate out of the way and permit the ice to fall into an ice storage bin 104. The ice bin 104 is provided within the ice storage compartment 102. Ice cubes are stored within the ice bin 104. The ice bin 104 is provided with a breaker bar or auger (not shown) to impartment movement to the stored ice for dispensing and to prevent ice bridging. The bin 104 is in operable communication with the ice dispenser 20 to dispense ice to the dispensing area 18 through the fresh food door 14.

After flowing across the ice mold 58, the air flows through the vent 33 in the movable flap 32 and the ice flow passage openings 30, 36 and around the ice bin 104. The ice bin 104 may be provided with vents (not shown) to permit some air flow through the ice in the ice bin 104. Return flow from the ice storage compartment can occur simultaneously with air flow into the ice storage container by passing through the ice flow passage opening 36 and then through the return vent 34, and then to the return duct 106 and then back to the riser duct 96. Return duct 106 is shown as being placed in a side wall; however, in practice the return duct may be placed in the rear wall as well.

Figure 5:
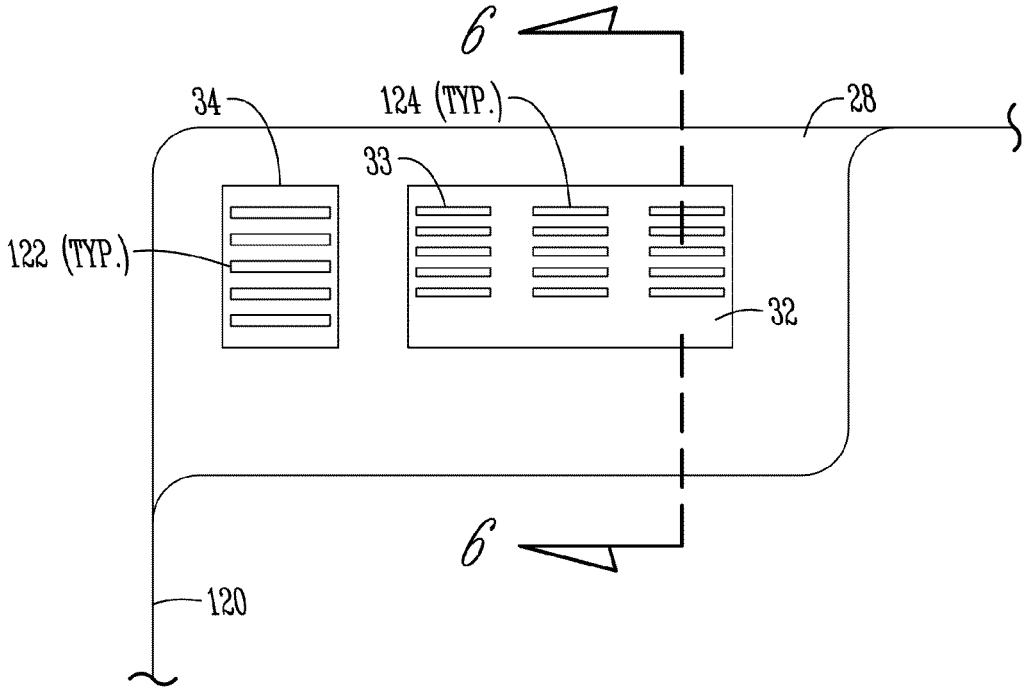
FIG. 5 is a detail view of the front of the ice compartment housing showing a vented flap according to one embodiment of the present invention.

FIG. 5 shows a close-up detail view of the front of the ice making compartment housing 28 when the fresh food door 14 is open. In particular, return vent 34 is provided near the outside wall 120 of the fresh food compartment. The return vent 34 includes a plurality of openings 122 that permit air to flow from the ice storage compartment to a return duct (see FIG. 6*a*) that eventually leads back to the evaporator or other chiller. In the embodiment shown, the openings 122 are elongated horizontal slots that match the styling of similar openings 124 that form the vent 33 in the moveable flap 32. For aesthetic reasons, it may be desirable to match the styling of the openings 122 and 124 with other air outlets, for example the outlets into the fresh food compartment. It should be appreciated that the openings 122 and 124 may take other forms than the horizontal elongated form shown in FIG. 5. For example, the openings 122 and 124 could be vertically or angularly oriented slots. Alternatively, the openings 122 and 124 could take many forms, for example circular, elliptical, crosses, or other shapes. Furthermore, the openings 122 and 124 need not match each other. As discussed in more detail below related to FIGS. 6*b* and 6*c*, the moveable flap 32 is biased by gravity to the closed position shown in FIG. 5, such that the moveable flap 32 blocks the opening 30 to provide a clean appearance and reduce flow of ambient air to the ice making compartment.

Figure 6A:
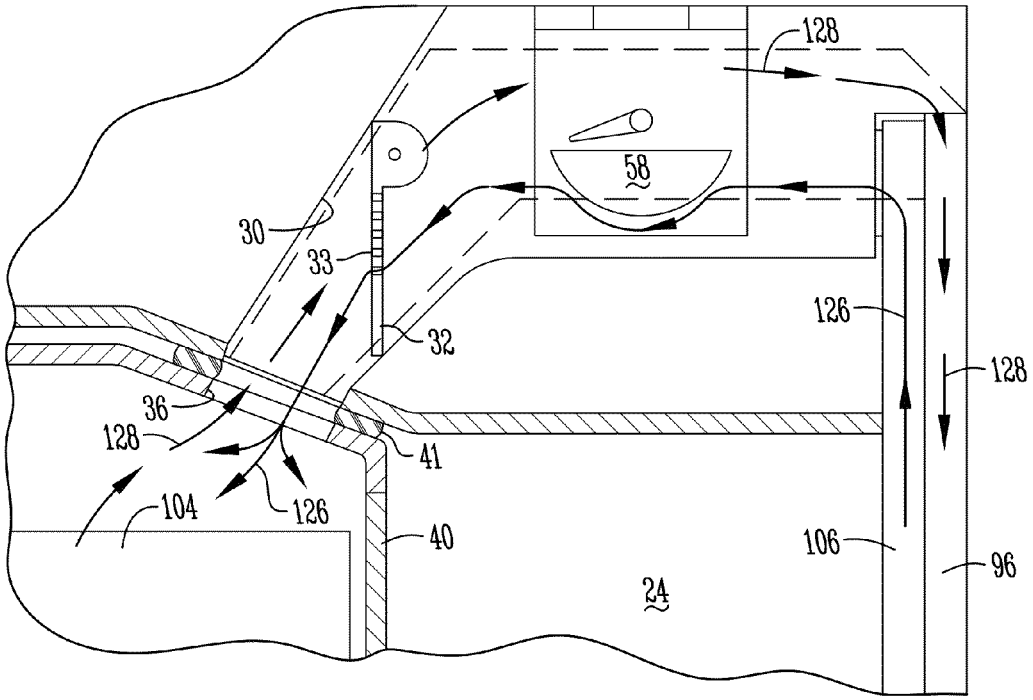
FIG. 6*a* is a partial cross-section view of the ice compartment housing of the embodiment of FIG. 5 showing air flow.

FIG. 6*a* is a partial cross-section of the ice making compartment housing 28 from FIG. 5, with a closed fresh food compartment door 14 added. FIG. 6 has been marked to show air flow. In particular, sold line 126 indicates a supply air pathway, and dashed line 128 indicates a return air pathway. The supply air 126 travels up riser duct 96, through an icemaking compartment outlet 130 where it flows around the ice mold 58 to chill the mold. The supply air pathway 126 continues past the ice mold 58 along the ice flow passage through the vent 33 in the moveable flap 32, through the icemaking compartment ice flow passage opening 30, and then through the ice storage compartment opening 36. The supply air 126 is prevented from leaking into the fresh food compartment 24 by the gasket 41. The supply air 126 may flow around and through the ice bin 104 to maintain any stored ice at an appropriate temperature. The return flow of air is indicated by dashed arrows 128. From the ice storage compartment, the return air 128 flows through the ice storage compartment opening 36, then through return vent (not shown in FIG. 6*a*, see element 34 in FIG. 5) to return conduit 132 (shown in broken lines) in the wall of the ice storage compartment. The return conduit 132 leads to return duct 106 that directs the return air 128 back to the chiller.

Figure 6B:
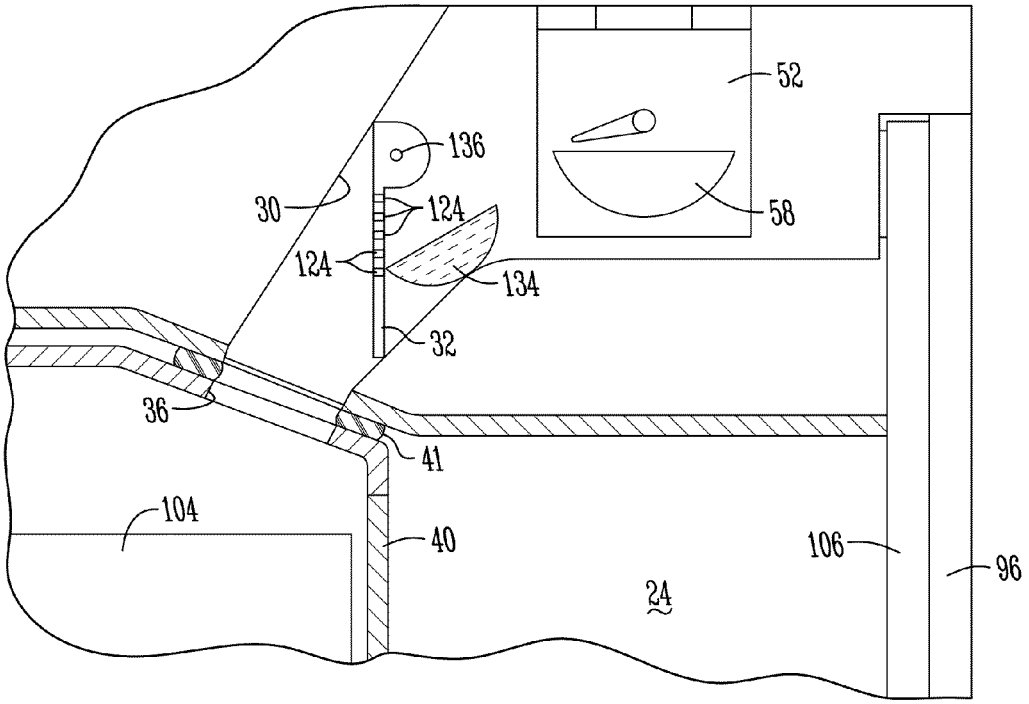
FIG. 6*b* is the partial cross-section view of FIG. 6*a*, with an ice cube starting along the ice flow passageway.
Figure 6C:
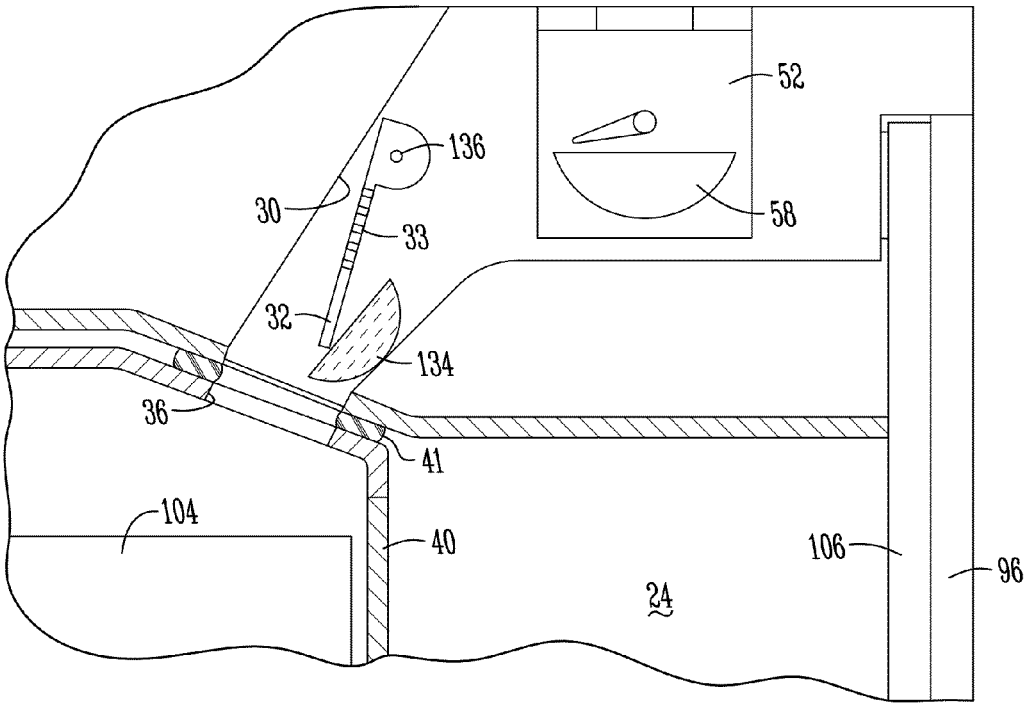
FIG. 6*c* is the partial cross-section view of FIG. 6*b*, with the ice cube further along the ice flow passageway opening the flap.

FIGS. 6*b* and 6*c* illustrate the ice flow from the ice maker 52 to the ice bin 104. The icemaker 52 harvests ice cubes 134 from the mold 58. The ice cubes 134 drop on to the bottom surface of opening 30, which is sloped downwardly and towards the fresh food door 14. The ice cubes 134 slide down that surface toward the moveable flap 32, as shown in FIG. 6*b*. As shown in FIG. 6*b*, the momentum of the ice cubes 134 causes the flap 32 to rotate about rotation members 136 to an open position that permits the ice cubes 134 to proceed on towards the ice storage bin 104. The rotation members 136 are supported by the walls that form opening 30. Other known mechanisms for mounting the moveable flap 32 may be used. The center of gravity of the moveable flap 32 is offset from the axis of rotation about the rotation members 136 when the moveable flap is raised by the ice cubes 134, as shown in FIG. 6*c*. Accordingly, once the ice 134 clears the moveable flap 32, a rotation moment is created that causes the flap 32 returns to the equilibrium position of FIG. 6*a*, with the flap 32 covering the opening 30.

It may be desirable to include a cut-off switch (not shown) that causes any harvest cycle by the ice maker 58 to terminate immediately upon the fresh food door 14 being opened. This will reduce the likelihood of ice cubes 134 falling through the moveable flap 33 and missing the ice bin 104 because the opening 36 is not in place to receive the cubes 134.

The invention has been shown and described above with reference to the preferred embodiments. It is understood that many modifications, substitutions, and additions may be made that are within the intended scope and spirit of the invention. The invention is only limited by the claims that follow.

What is claimed is:

1. A refrigerator comprising:
a cabinet;
a door on the cabinet;
an icemaker within the cabinet;
an ice storage area on the door;
an ice flow passage between the icemaker and the ice storage area;
a movable flap associated with the ice flow passage, the movable flap having an equilibrium position wherein the movable flap substantially covers the ice flow passage; and
a vent bounded by two pairs of opposing edges of the movable flap to permit air flow through the ice flow passage to the ice storage area with the movable flap in the equilibrium position;
wherein the two pairs of opposing edges of the movable flap further comprises an upper edge opposite a lower edge, and two opposing side edges extending between the upper edge and the lower edge, and wherein the vent is an elongated horizontal slot oriented parallel to the upper edge and the lower edge.

2. The refrigerator of claim 1, wherein the movable flap is movable to a dispensing position that permits ice to flow from the icemaker to the ice storage area.

3. The refrigerator of claim 2, wherein as ice moves through the ice passage from the icemaker towards the ice storage area, the momentum of the moving ice moves the movable flap from the equilibrium position to the dispensing position.

4. The refrigerator of claim 3, wherein the movable flap is biased to automatically move from the dispensing position to the equilibrium position.

5. The refrigerator of claim 4, wherein gravity biases the movable flap from the dispensing position to the equilibrium position.

6. The refrigerator of claim 5, wherein the movable flap has a center of gravity, wherein the movable flap is mounted to rotate about a rotation member, and wherein when the movable flap is in the dispensing position the center of gravity is offset from the rotation member to create a moment force about the rotation member that urges the movable flap towards the equilibrium position.

7. The refrigerator of claim 1, wherein the vent comprises a plurality of elongated horizontal slots, wherein each of the plurality of elongated horizontal slots are bounded by the two pairs of opposing edges of the movable flap.

8. The refrigerator of claim 1, further comprising a return vent in the cabinet for exhausting air from the ice storage area back to the cabinet.

9. The refrigerator of claim 8, wherein the door comprises a gasket disposed on the ice storage area of the door that engages the cabinet and surrounds the ice flow passage, the vent, and the return vent when the door is in a closed position to prevent air from leaking from the ice storage area to a fresh food compartment.

10. A refrigerator comprising:
an icemaker in a refrigerator cabinet;
an ice container on a door, the door being mounted to the refrigerator cabinet;
an ice compartment housing mounted within the refrigerator cabinet;
a passageway within the ice compartment housing positioned to receive ice from the icemaker;
a return vent within the ice compartment housing to exhaust air from the ice container to the refrigerator cabinet;
a movable flap rotatably mounted to the ice compartment housing, the movable flap having an equilibrium position that substantially covers the passageway; and
an opening through the movable flap;
wherein the passageway and the return vent both extend through a same surface of the ice compartment housing.

11. The refrigerator of claim 10, wherein a bottom surface of the passageway slopes downwardly towards the movable flap.

12. The refrigerator of claim 11, wherein the ice sliding on the bottom surface under the force of gravity moves the movable flap from the equilibrium position to a dispensing position that permits the ice to move to the ice container.

13. The refrigerator of claim 10, wherein the movable flap has a center of gravity, wherein the movable flap is mounted to rotate about a rotation member, and wherein when the movable flap is in a dispensing position the center of gravity is offset from the rotation member to create a moment force about the rotation member that urges the movable flap towards the equilibrium position.

14. The refrigerator of claim 10, wherein the opening is an elongated horizontal slot.

15. The refrigerator of claim 10, wherein the opening comprises a plurality of elongated horizontal slots.

16. The refrigerator of claim 10, wherein the opening is fully bounded within with movable flap.

17. The refrigerator of claim 10, further comprising a gasket that contacts the ice compartment housing and surrounds the passageway and the return vent when the door is in a closed position to prevent cold air from leaking from the passageway and the return vent to a fresh food compartment.

18. A refrigerator comprising:
a cabinet;
a door on the cabinet;
an icemaker within the cabinet;
an ice storage area on the door;
an ice compartment housing mounted within the cabinet;
a movable flap associated with the ice compartment housing, the movable flap having a vent and an equilibrium position wherein the movable flap substantially covers an ice flow passage;
a return vent associated with the ice compartment housing proximate to the movable flap to exhaust air from the ice storage area to the refrigerator cabinet; and
a gasket that contacts the ice compartment housing and surrounds the moveable flap and the return vent when the door is in a closed position to prevent cold air from leaking from the passage and the return vent to a fresh food compartment.

* * * * *